United States Patent [19]

McCarty et al.

[11] 4,291,444

[45] Sep. 29, 1981

[54] PROCESS OF MANUFACTURING A TUNGSTEN LAMP FILAMENT

[75] Inventors: Lewis V. McCarty, Cleveland Heights; John W. Pugh, Gates Mills, both of Ohio

[73] Assignee: General Electric Company, Schenectady, N.Y.

[21] Appl. No.: 937,545

[22] Filed: Aug. 28, 1978

[51] Int. Cl.[3] ..... B21F 3/04; B21F 45/00

[52] U.S. Cl. ..... 29/25.14; 29/25.18; 29/424; 140/71.5

[58] Field of Search ..... 29/25.17, 25.18, 423, 29/25.14, 424; 140/71 R, 71.5, 92.1; 313/344

[56] References Cited

U.S. PATENT DOCUMENTS

| | | | |
|---|---|---|---|
| 2,723,926 | 11/1955 | Bellott | 140/71.5 |
| 3,285,293 | 11/1966 | Matheson | 140/71.5 |
| 3,461,921 | 8/1969 | Ackerman | 140/71.5 |
| 3,662,789 | 5/1972 | Koo et al. | 140/71.5 |
| 3,812,393 | 5/1974 | Koo et al. | 313/344 |
| 3,865,074 | 2/1975 | Cornelissen et al. | 118/49.5 |
| 3,877,495 | 4/1975 | Koo et al. | 140/71.5 |
| 4,049,024 | 9/1977 | Auborn et al. | 140/71.5 |

FOREIGN PATENT DOCUMENTS

| | | | |
|---|---|---|---|
| 43-24705 | 10/1968 | Japan | 140/71.5 |

*Primary Examiner*—Ervin M. Combs

*Attorney, Agent, or Firm*—John F. McDevitt; Lawrence R. Kempton

[57] ABSTRACT

An electric lamp filament of tungsten is disclosed that has been coiled and heat-treated to at least 1600° C. on a wire mandrel containing molybdenum but which is essentially free of molybdenum contamination. A barrier layer of tungsten or tantalum is provided on said mandrel to preclude the molybdenum contamination and the coated mandrel can thereafter be dissolved from the uncontaminated tungsten filament coil in an acid mixture.

5 Claims, 1 Drawing Figure

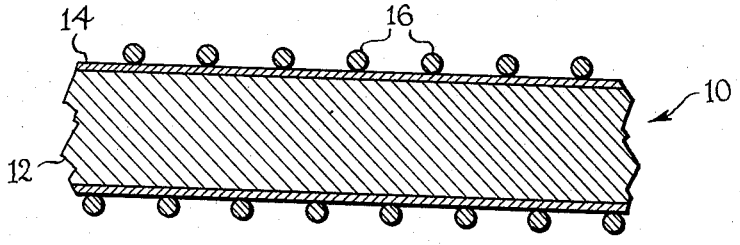
14
16
10
12

PROCESS OF MANUFACTURING A TUNGSTEN LAMP FILAMENT

BACKGROUND OF THE INVENTION

Coiled tungsten filaments are now used in incandescent and fluorescent lamps as well as other type electric lamps and a serious problem associated therewith occurs when these lamp filaments are manufactured. Specifically, these tungsten lamp filaments are customarily coiled and heat-treated on a wire mandrel at temperatures sufficiently elevated to produce contamination from the mandrel material. Such contamination can be avoided by controlling the temperature of heat treatment below the range where contaminant transport to the filament occurs. Thus, temperatures are generally maintained below 1100° when a steel mandrel is used and 1600° when a molybdenum mandrel is used. Such temperatures are close to the safe limit because of the need to maximize stress relaxation in the filament material. The coating of steel mandrels with certain metals has also been proposed but with said coatings consisting of non-refractory metals having melting temperatures considerably below the melting temperature of the tungsten filament. The coating of steel wire mandrels in this manner is said to permit heat treatment of tungsten filaments coiled thereon to temperatures around 1300° C. which is sufficiently elevated to at least permit some annealing of the tungsten filaments and the coated wire mandrels are said to be dissolved thereafter in a customary manner.

SUMMARY OF THE INVENTION

It has now been discovered that significantly more barrier layer protection can be afforded to coiled tungsten filaments manufactured for electric lamps by a process which includes coiling and heat treatment upon a molybdenum mandrel when said molybdenum mandrel is coated with particular refractory metals, namely tungsten and tantalum. Thus, a molybdenum mandrel coated with tantalum permits heat treatment of tungsten filaments coiled thereon to be increased approximately 200° C. from the 1600° C. temperature limit previously imposed to avoid molybdenum contamination of the filament during the treatment. An even greater elevation of the temperature limit for heat treatment is possible when the molybdenum wire mandrel is properly coated with tungsten and which permits full stress relaxation of the tungsten filaments coiled thereon to be achieved by heat treatment to include recrystallization of the tungsten coil material. It has also been found that such refractory metal coated molybdenum mandrels can subsequently be dissolved in the customary manner from the heat-treated coiled tungsten filaments and without significant detrimental effect upon the tungsten coil material.

In a preferred embodiment, a protective tantalum deposit was produced on the molybdenum mandrel wire by chemical vapor deposition technique wherein a volatilized tantalum precursor material was thermally decomposed to produce a coating thickness in the range 2–14 micrometers thickness. A uniform and smooth coating of tantalum crystallites resulted having sufficient integrity to preclude the thermal diffusion of molybdenum therethrough when employed for manufacture of coiled tungsten filaments in the manner previously described. In a different preferred embodiment, a protective tungsten deposit was achieved on the molybdenum wire mandrel by the same general vapor deposition technique with a volatile tungsten precursor material and which produced heavier coatings up to approximately 25 micrometers thickness sufficient to avoid molybdenum contamination of tungsten lamp filaments when coiled and heat-treated thereon as previously described. Surprisingly, the attack by an acid mixture subsequently employed to dissolve the tungsten-coated molybdenum wire mandrel proved much less severe on the coiled tungsten filaments than on the mandrel itself which is a significant benefit for commercial practicality of the present discovery.

It is a general object of the present invention, therefore, to provide an improved electric lamp filament of tungsten when coiled and heat-treated to a temperature of at least 1600° C. on a wire mandrel containing molybdenum which is essentially free of molybdenum contamination.

A further important object of the present invention is to provide an improved method of manufacturing a tungsten lamp filament which includes coiling and heat treatment of said coiled filament to a temperature of at least 1600° C. on a wire mandrel containing molybdenum which is not accompanied by contamination of the coiled lamp filament with molybdenum.

These objects and others which will become apparent from the following detailed description are achieved by providing a barrier layer coating on said wire mandrel with a refractory metal selected from tungsten and tantalum.

DESCRIPTION OF THE DRAWING

The accompanying drawing represents a cross sectional view of a coiled tungsten filament in combination with a molybdenum containing mandrel modified in accordance with the present invention.

DESCRIPTION OF THE PREFERRED EMBODIMENTS

The accompanying drawing depicts the manner in which the present improvement is carried out. Specifically, a wire mandrel 10 is shown having a central core 12 of molybdenum metal or other suitable molybdenum alloy and which further includes a coating 14 of tantalum or tungsten. Said coating 14 can be deposited on said molybdenum containing wire mandrel by various techniques and a convenient deposition method is more fully described hereinafter. Wound around said coated wire mandrel 10 is a coiled lamp filament 16 of tungsten metal which can further include the conventional additives now employed for some lamp product applications. Said coiled lamp filament 16 is formed about said refractory metal coated mandrel in the customary manner and thereafter heat-treated in place on said coated mandrel to produce a metallurgical structure in the tungsten material suitable for the particular lamp product involved. Following said heat treatment, the coiled tungsten filament 16 can be further processed in the customary manner and which generally includes dissolving the mandrel from the coiled filament by immersion in a known or modified acid mixture.

Chemical vapor deposition provides a convenient method to deposit both tantalum and tungsten barrier layers on the molybdenum containing wire mandrel in a form substantially precluding thermal transport of the underlying molybdenum to a tungsten lamp filament coiled thereon. Such transport barrier layer can be provided in this manner by simply heating the mandrel wire utilizing its electrical resistance in a suitable reaction chamber containing an atmosphere of the selected refractory metal precursor material in a gaseous state. Accordingly, tantalum chloride can be supplied at 80°–100° C. in a vacuum reaction chamber containing the heated molybdenum mandrel wire for thermal decomposition of said precursor material on the heated molybdenum wire surface at temperatures around 1300° C. and for times varying between 20 minutes and 3 hours to produce tantalum-protecting coatings varying in thickness from 2 micrometers to 14 micrometers as previously disclosed. A uniform and smooth coating of tantalum was achieved in this manner. The relative degree of freedom from molybdenum contamination for coiled tungsten lamp filaments prepared in the foregoing manner was determined with conventional electron beam microprobe analyses. Specifically, samples of approximately 0.13 millimeter diameter lamp grade tungsten wire were prepared which had been coiled at the rate of 59 tunrs per centimeter length on a 0.35 millimeter diameter molybdenum mandrel wire that had been precoated with a 7.0 micrometers thick tantalum coating and with said coiled tungsten lamp filaments thereafter having been heat-treated while on said mandrel in a Brew vacuum furnace at 100° C. temperature intervals from 1500° C. to 2500° C. for 10 minutes. Control samples of the same tungsten lamp filaments coiled upon uncoated mandrels evidenced molybdenum contamination at heat treatment temperatures of 2000° C. and higher. Molybdenum contamination for the samples coiled upon the coated mandrels was observed only after the heat treatments commencing at 2200° C. On the basis of said examination, it follows that annealing temperatures were elevated approximately 200° C. by use of the protective tantalum coating on the molybdenum wire mandrel although the above identified analysis did further indicate some presence of tantalum in the coiled tungsten filaments occurring at heat treatment temperatures of 2000° C. and higher. Such tantalum migration was not found detrimental in lamp applications, however, since the black deposits ordinarily encountered during lamp operation with molybdenum contamination of the coiled tungsten lamp filaments did not similarly occur with these tantalum contaminated coils.

Further tests were conducted with dissolving the above tantalum-coated mandrels in standard molybdenum dissolving acids. The dissolution of said tantalum-coated mandrels was readily achieved in an acid mixture comprising 33 weight percent nitric acid and 37 percent sulfuric acid at 60° C. in time periods as short as 5 minutes. Since the rate of dissolution from these tests was found to be comparable to dissolution of uncoated molybdenum wire mandrels, it can be concluded that such coatings are not only technically feasible but commercially practical as well.

In a different embodiment of the present invention, tungsten coatings were deposited upon the same molybdenum mandrel wire utilizing the same general chemical vapor deposition techniques above described. Such tungsten barrier layer was deposited on the heated molybdenum wire at approximately 600° C. by thermally decomposing tungsten hexafluoride which had been admitted to the reaction vessel as a mixture with hydrogen gas. Said tungsten deposit had a matte appearance of columnar-shaped crystals although advantageously deposited at a faster rate and lower temperature than accomplished with the tantalum coatings previously described. Again, the coated 0.35 millimeter diameter molybdenum mandrel wire was utilized to coil 0.13 millimeter diameter ordinary lamp grade tungsten wire at 59 turns per centimeter length and said coiled tungsten lamp filaments thereafter subjected to heat treatment in the Brew vacuum furnace at 100° intervals from 1500° C. to 2500° C. for ten minutes at each interval. The microprobe analysis upon said samples found no molybdenum contamination in the tungsten coil even at the 2400° C. annealing temperature where some tungsten recrystallization was observed. On the other hand, dissolution of the tungsten-coated molybdenum mandrels was not as readily achieved compared with the tantalum-coated mandrels. A forty-five minute exposure was needed to dissolve molybdenum mandrels coated with approximately 2 micrometers thickness tungsten coating in a boiling mixture of nitric acid and sulfuric acid which further contained a small amount of hydrochloric acid and a fluorosurfactant. Such slower rate of dissolution is not regarded as rendering the embodiment technically unfeasible, however, since less than 1 percent loss of tungsten from the coiled tungsten lamp filaments was experienced during the acid treatment. Moreover, no defects could be visually observed in the coiled tungsten lamp filaments after completion of the overall manufacturing process.

It will be apparent from the foregoing description that a generally useful method has been discovered to protect electric lamp filaments of tungsten from molybdenum contamination when coiled and heat treated on molybdenum wire mandrels and which affords higher annealing temperatures of the tungsten coils on the modified mandrels to be used. It will also be apparent that modifications of such improved process of manufacturing tungsten filaments than above specifically disclosed are possible without departing from the spirit and scope of the present invention. For example, it is contemplated that deposition methods other than chemical vapor deposition can prove equally suitable for the purpose of coating the molybdenum wire mandrel with the particular refractory metal selected. It is intended to limit the present invention, therefore, only by the scope of the following claims.

What we claim as new and desire to secure by United States Letters Patent is:

1. An improved process of manufacturing a tungsten lamp filament which includes coiling and heat treating said filament to at least 1600° C. on a molybdenum wire mandrel until significant stress relaxation has taken place, wherein the improvement comprises coating the bare metal surface of said wire mandrel with a chemical vapor deposit of a refractory metal selected from tungsten and tantalum prior to said coiling and heat treating steps to thereby prevent molybdenum contamination of said tungsten filament.

2. An improved process as in claim 1 wherein the tungsten filament is recrystallized.

3. An improved process as in claim 1 wherein the tungsten filament is annealed.

4. An improved process as in claim 1 wherein the wire mandrel is molybdenum coated with tungsten.

5. An improved process as in claim 1 wherein the wire mandrel is molybdenum coated with tantalum.

* * * * *